US009229409B2

(12) United States Patent
Imazeki et al.

(10) Patent No.: US 9,229,409 B2
(45) Date of Patent: Jan. 5, 2016

(54) CLEANING BLADE FAILURE PREDICTION PROCESSOR AND IMAGE FORMING APPARATUS INCORPORATING SAME

(71) Applicants: Mikiko Imazeki, Kanagawa (JP); Yasushi Nakazato, Tokyo (JP); Akira Takehisa, Tokyo (JP); Osamu Satoh, Kanagawa (JP)

(72) Inventors: Mikiko Imazeki, Kanagawa (JP); Yasushi Nakazato, Tokyo (JP); Akira Takehisa, Tokyo (JP); Osamu Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/642,005

(22) Filed: Mar. 9, 2015

(65) Prior Publication Data

US 2015/0253714 A1 Sep. 10, 2015

(30) Foreign Application Priority Data

Mar. 10, 2014 (JP) ..... 2014-046208

(51) Int. Cl.
*G03G 21/00* (2006.01)
*G03G 15/00* (2006.01)

(52) U.S. Cl.
CPC ..... *G03G 15/556* (2013.01); *G03G 21/0029* (2013.01)

(58) Field of Classification Search
CPC G03G 15/0812; G03G 15/556; G03G 21/029
USPC ..... 399/32, 350
See application file for complete search history.

(56) References Cited

U.S. PATENT DOCUMENTS

| | | | |
|---|---|---|---|
| 2005/0002054 | A1 | 1/2005 | Shoji et al. |
| 2005/0281596 | A1 | 12/2005 | Nakagawa et al. |
| 2005/0286916 | A1 | 12/2005 | Nakazato et al. |
| 2006/0182451 | A1 | 8/2006 | Shoji et al. |
| 2006/0294252 | A1 | 12/2006 | Shoji et al. |
| 2007/0127934 | A1 | 6/2007 | Shoji et al. |
| 2008/0068639 | A1 | 3/2008 | Satoh et al. |

(Continued)

FOREIGN PATENT DOCUMENTS

| | | |
|---|---|---|
| JP | 1-121865 | 5/1989 |
| JP | 2002-328496 | 11/2002 |

(Continued)

OTHER PUBLICATIONS

Machine translation of JP 2010-175831.*

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A cleaning blade failure prediction processor for an image forming apparatus includes a pixel count acquisition circuit to acquire pixel count data of a cleaning target of a cleaning blade. The cleaning target is divided into a plurality of areas in a main scanning direction of the cleaning target. The pixel count acquisition circuit acquires a pixel count for each of the plurality of areas of the cleaning target. The cleaning blade failure prediction processor also includes a first cumulative pixel count calculation circuit to calculate a cumulative pixel count for each of the plurality of areas of the cleaning target, a second cumulative pixel count calculation circuit to calculate a cumulative pixel count per distance traveled of the cleaning target, and a deformation identification circuit to determine whether or not the cleaning blade shows signs of deformation according to the cumulative pixel count per distance traveled.

10 Claims, 6 Drawing Sheets

(56) References Cited

U.S. PATENT DOCUMENTS

| | | | |
|---|---|---|---|
| 2008/0075476 | A1 | 3/2008 | Nakazato et al. |
| 2008/0199193 | A1 | 8/2008 | Nakazato et al. |
| 2009/0033993 | A1 | 2/2009 | Nakazato et al. |
| 2009/0041481 | A1 | 2/2009 | Iida et al. |
| 2009/0052912 | A1 | 2/2009 | Shoji et al. |
| 2009/0190939 | A1 | 7/2009 | Satoh et al. |
| 2009/0196634 | A1 | 8/2009 | Satoh et al. |
| 2009/0319827 | A1 | 12/2009 | Nakazato et al. |
| 2009/0322524 | A1 | 12/2009 | Nakazato et al. |
| 2009/0324259 | A1 | 12/2009 | Ue et al. |
| 2010/0094594 | A1 | 4/2010 | Yamashita et al. |
| 2010/0098471 | A1 | 4/2010 | Satoh et al. |
| 2011/0004419 | A1 | 1/2011 | Ue et al. |
| 2011/0007337 | A1 | 1/2011 | Imazeki et al. |
| 2011/0052224 | A1 | 3/2011 | Yamashina et al. |
| 2011/0106489 | A1 | 5/2011 | Satoh et al. |
| 2011/0170884 | A1 | 7/2011 | Yamane et al. |
| 2011/0206393 | A1 | 8/2011 | Nakazato et al. |
| 2012/0065885 | A1 | 3/2012 | Imazeki et al. |
| 2013/0028615 | A1 | 1/2013 | Satoh et al. |
| 2013/0251383 | A1 | 9/2013 | Imazeki et al. |
| 2013/0272723 | A1 | 10/2013 | Imazeki et al. |
| 2014/0016951 | A1 | 1/2014 | Takehisa et al. |
| 2014/0321865 | A1 | 10/2014 | Takehisa et al. |

FOREIGN PATENT DOCUMENTS

| | | |
|---|---|---|
| JP | 2007-183445 | 7/2007 |
| JP | 2007-187734 | 7/2007 |
| JP | 2008-225240 | 9/2008 |
| JP | 2008-299009 | 12/2008 |
| JP | 2010-175831 | 8/2010 |

* cited by examiner

CLEANING BLADE FAILURE PREDICTION PROCESSOR AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2014-046208, filed on Mar. 10, 2014, in the Japan Patent Office, the entire disclosure of which is hereby incorporated by reference herein.

BACKGROUND

1. Technical Field

Embodiments of the present invention generally relate to a cleaning blade failure predictor and an image forming apparatus, and more particularly, to a cleaning blade failure prediction processor for predicting a failure resulting from deformation of a cleaning blade that contacts and cleans a cleaning target, and to an image forming apparatus incorporating the cleaning blade failure prediction processor:

2. Background Art

Various types of electrophotographic image forming apparatuses are known, including copiers, printers, facsimile machines, or multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium.

In such image forming apparatuses, after the toner image is transferred from the photoconductor, there may be residual toner that fails to be transferred from the photoconductor and therefore remaining on the photoconductor. Similarly, after the toner image is transferred from the intermediate transfer belt, there may be residual toner that fails to be transferred from the intermediate transfer belt and therefore remaining on the intermediate transfer belt. To remove such residual toner, the image forming apparatuses typically include cleaners provided with cleaning blades that contact the photoconductor or the intermediate transfer belt to remove residual toner therefrom.

SUMMARY

In one embodiment of the present invention, an improved cleaning blade failure prediction processor for an image forming apparatus is described that includes a pixel count. acquisition circuit to acquire pixel count data of a cleaning target of a cleaning blade. The cleaning target is divided into a plurality of areas in a main scanning direction of the cleaning target. The pixel count acquisition circuit acquires a pixel count for each of the plurality of areas of the cleaning target. The improved cleaning blade failure prediction processor also includes a first cumulative pixel count calculation circuit to calculate a cumulative pixel count for each of the plurality of areas of the cleaning target, a second cumulative pixel count calculation circuit to calculate a cumulative pixel count per distance traveled of the cleaning target, and a deformation identification circuit to determine whether or not the cleaning blade shows signs of deformation according to the cumulative pixel count per distance traveled.

Also described is an improved image forming apparatus incorporating the cleaning blade failure prediction processor and an image formation device that includes the cleaning blade, failure of which is predicted by the cleaning blade failure prediction processor.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
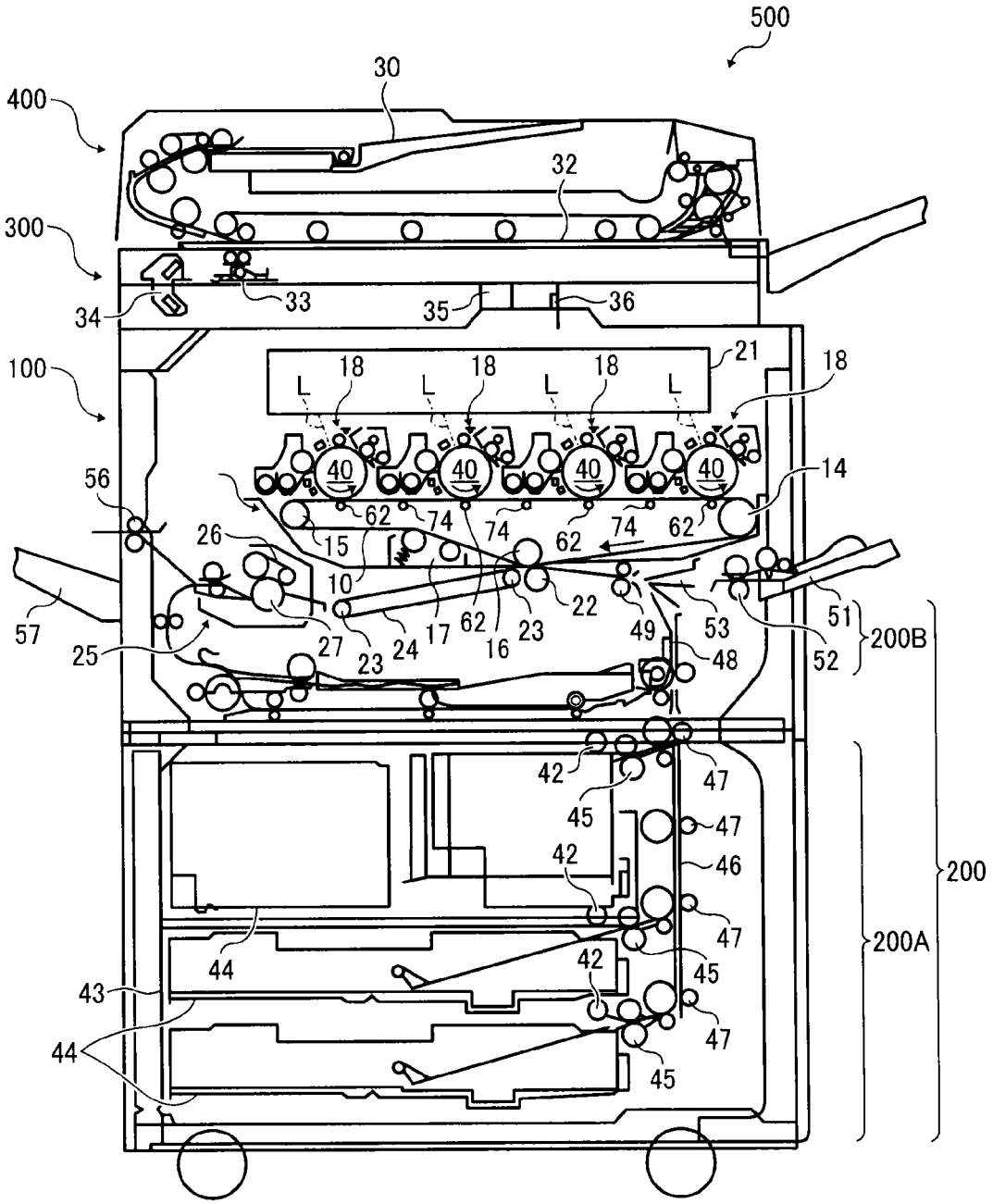
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes K, Y. M, and C denote colors black, yellow, magenta, and cyan, respectively. To simplify the description, these suffixes are omitted unless necessary. Similarly, to simplify the drawings, these suffixes are omitted unless necessary.

Referring now to the drawings, wherein like reference numerals designate identical or corresponding parts throughout the several views, embodiments of the present invention are described below.

Initially with reference to FIG. 1, a description is given of an image forming apparatus 500 according to an embodiment of the present invention.

FIG. 1 is a schematic view of the image forming apparatus 500. In the present embodiment, the image forming apparatus 500 is a tandem-type color printer. The image forming apparatus 500 includes a printer unit 100, a sheet feeder 200, a scanner 300, and a document feeder 400. The scanner 300 is disposed atop the printer unit 100. The document feeder 400 is disposed atop the scanner 300. In the present embodiment, the document feeder 400 is an automatic document feeder (ADF).

Figure 3:
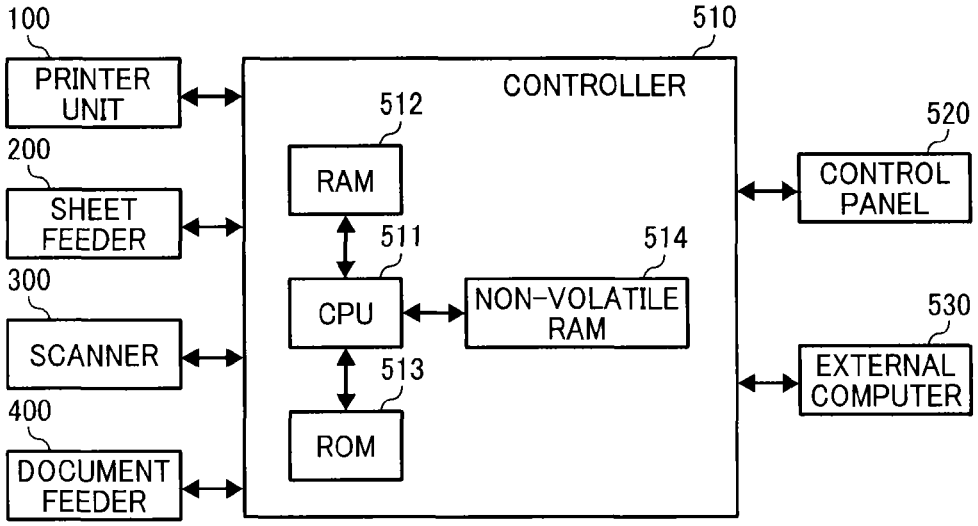
FIG. 3 is a block diagram of a controller incorporated in the image forming apparatus.

The scanner 300 includes an exposure glass 32, first and second carriers 33 and 34. an image forming lens 35, and a sensor 36. The scanner 300 reads image data of a document placed on the exposure glass 32 with the sensor 36, and sends the image data thus read to a controller 510, which is illustrated in FIG. 3. According to the image data received from the scanner 300, the controller 510 controls, e.g., a laser and a light-emitting diode (LED) array disposed inside an exposure device 21 to irradiate surfaces of four drum-shaped photoconductors 40K, 40Y, 40M, and 40C with laser beams L. The exposure device 21 and the photoconductors 40K, 40Y, 40M, and 40C are included in the printer unit 100, disposed facing each other. Thus, an electrostatic latent image is formed on each of the surfaces of the photoconductors 40K, 40Y, 40M, and 40C, and developed into a visible toner image through a predetermined development process.

In addition to the exposure device 21 and the photoconductors 40, the printer unit 100 includes, e.g., a secondary transfer device 22, a fixing device 25, a paper ejection device such as a pair of paper ejection rollers 56, and a toner supplier.

The sheet feeder 200 includes an automatic feeding section 200A provided below the printer unit 100, and a manual bypass section 200B provided on a side of the printer unit 100. The automatic feeding section 200A includes, e.g., a paper bank 43, a plurality of paper trays 44 disposed one above the other in the paper bank 43, feed rollers 42 each of which picks up a recording medium from the corresponding paper tray 44, pairs of first separation rollers 45 each of which separates the recording medium from the corresponding paper tray 44 and sends the recording medium to a first conveyance passage 46, and pairs of conveyor rollers 47 each of which conveys the recording medium toward a second conveyance passage 48.

The bypass section 200B includes, e.g., a bypass tray 51 and a pair of second separation rollers 52 that separates a recording medium from another one placed on the bypass tray 51 to send the recording medium thus separated toward a bypass conveyance passage 53. A pair of registration rollers 49 is disposed around an end of the second conveyance passage 48 in the printer unit 100. The pair of registration rollers 49 receives the recording medium sent from one of the paper trays 44 or from the bypass tray 51, and then sends the recording medium at a predetermined time to a secondary transfer nip formed between the secondary transfer device 22 and an endless intermediate transfer belt 10 serving as an intermediate transfer body.

A document is placed on a document table 30 of the document feeder 400 to copy a color image or, alternatively, the document feeder 400 is opened and the document is placed on the exposure glass 32 of the scanner 300, and then closes the document feeder 400 to press the document against the exposure glass 32. Thereafter, the operator presses a start button. The scanner 300 is activated after the document is conveyed onto the exposure glass 32 if the document is placed on the document feeder 400. Alternatively, the scanner 300 is activated immediately if the document is placed on the exposure glass 32. Specifically, the first and second carriers 33 and 34 move, and light emitted from a light source of the first carrier 33 is reflected from a surface of the document toward the second carrier 34. The light is then reflected from a mirror of the second carrier 34 and reaches the sensor 36 via the image forming lens 35. The sensor 36 reads the light as image data.

When the image data is read as described above, the printer unit 100 rotates one of support rollers 14, 15, and 16 with a drive motor so that the other two support rollers are rotated. The support rollers 14, 15, and 16 rotate the endless intermediate transfer belt 10 that is entrained around the support rollers 14, 15, and 16. In addition, as described above, the exposure device 21 irradiates the surfaces of the photoconductors 40 with the laser beams L to form latent images thereon. The latent images are rendered visible as toner images in a developing process. Thus, toner images of black, yellow, magenta, and cyan are formed on the photoconductors 40K, 40Y, 40M, and 40C, respectively, while the photoconductors 40K, 40Y, 40M, and 40C are rotating. Sequentially, the toner images are electrostatically transferred onto the intermediate transfer belt 10 at respective primary transfer nips where the intermediate transfer belt 10 contacts the photoconductors 40K, 40Y, 40M, and 40C, so that the toner images are superimposed one atop another on the intermediate transfer belt 10 to form a four-color toner image thereon.

In the meantime, the sheet feeder 200 rotates one of the three feed rollers 42 to direct a recording medium having an appropriate size for the image data toward the second conveyance passage 48 of the printer unit 100. When the recording medium reaches the pair of registration rollers 49 through the second conveyance passage 48, the pair of registration rollers 49 temporarily stops the recording medium, and then conveys the recording medium at a predetermined time toward the secondary transfer nip where the intermediate transfer belt 10 contacts a secondary transfer roller 23 of the secondary transfer device 22. At the secondary transfer nip, the four-color toner image formed on the intermediate transfer belt 10 and the recording medium are synchronized to stick together. A transfer electrical field and physical pressure at the secondary transfer nip transfers the four-color toner image onto the recording medium to form a full-color toner image thereon combined with a white color of the recording medium.

After passing through the secondary transfer nip, the recording medium is conveyed to the fixing device 25 as an endless conveyor belt 24 of the secondary transfer device 22 rotates. In the fixing device 25, the full-color toner image is fixed onto the recording medium under heat applied by a heating belt 26 and pressure applied by a pressing roller 27. Thereafter, the recording medium is ejected by the pair of paper ejection rollers 56 onto a paper ejection tray 57 provided on a side of the printer unit 100.

The printer unit 100 further includes, e.g., a belt unit, a belt cleaner 17, four primary transfer rollers 62K, 62Y, 62M, and 62C, and four process units 18K, 18Y. 18M, and 18C serving as image formation devices that form toner images of black, yellow, magenta, and cyan, respectively. The belt unit moves the endless intermediate transfer belt 10, entrained around the support rollers 14, 15, and 16, in contact with the photoconductors 40K, 40Y, 40M, and 40C. At the primary transfer nips where the intermediate transfer belt 10 contacts the photoconductors 40K, 40Y, 40M, and 40C, the primary transfer rollers 62K, 62Y, 62M, and 62C presses the back surface of the intermediate transfer belt 10 against the photoconductors 40K, 40Y, 40M, and 40C, respectively. A primary transfer bias is applied to each of the primary transfer rollers 62K, 62Y, 62M, and 62C by a power source to form a primary transfer electrical field that electrostatically moves the toner images from the photoconductors 40K, 40Y, 40M, and 40C to the intermediate transfer belt 10 at the primary transfer nips. Conductive rollers 74 are disposed between adjacent rollers of the primary transfer rollers 62K, 62Y, 62M, and 62C to contact the back surface of the intermediate transfer belt 10. The conductive rollers 74 prevent the primary transfer bias applied to the primary transfer rollers 62K, 62Y, 62M, and 62C from flowing into the respective process units 18K, 18Y, 18M, and 18C via a base layer of intermediate electrical resistance on the back surface of the intermediate transfer belt 10.

Figure 2:
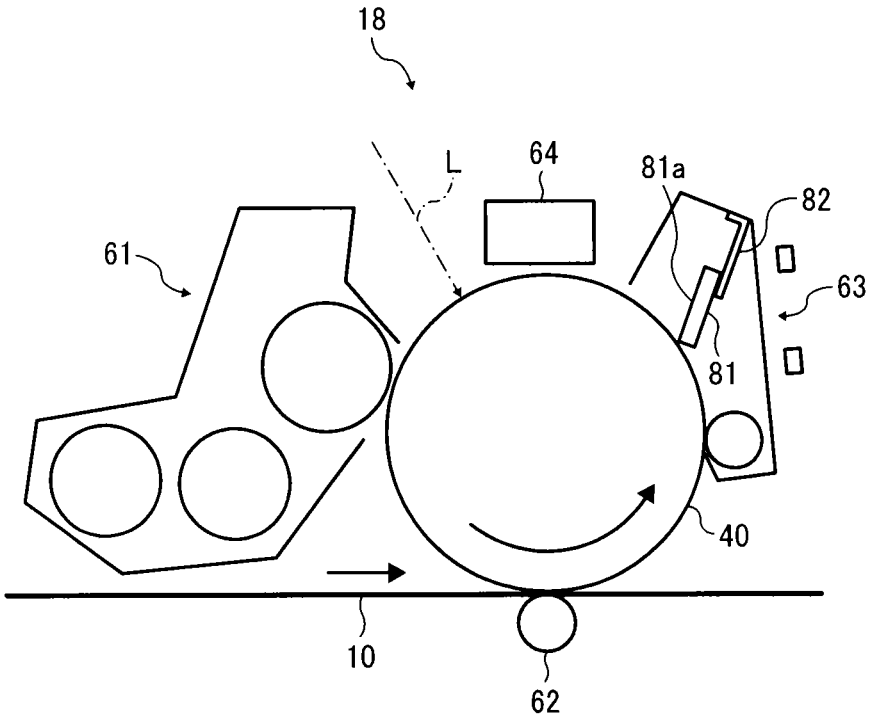
FIG. 2 is a schematic view of a process unit incorporated in the image forming apparatus.

Referring now to FIG. 2, a detailed description is given of the process units 18.

FIG. 2 is a schematic view of one of the process units 18. The process units 18K, 18Y, 18M, and 18C are identical in configuration, differing only in color of toner employed. Therefore, to simplify the description and the drawings, these suffixes are omitted unless necessary.

The process unit 18 includes the photoconductor 40 irradiated with the laser beams L emitted from the exposure device 21, a developing unit 61 that develops a latent image formed on the surface of the photoconductor 40 with toner, and a cleaner 63 that removes residual toner that fails to be transferred onto the intermediate transfer belt 10 and therefore remaining on the surface of the photoconductor 40 from the photoconductor 40. The process unit 18 also includes a neutralizing device that neutralizes the surface of the photoconductor 40 from which the residual toner is removed, and a charging device 64 that uniformly charges the neutralized surface of the photoconductor 40. The cleaner 63 includes a cleaning blade 81 that contacts the photoconductor 40, and a holder 82 that holds an end of the cleaning blade 81. On the other end of the cleaning blade 81, the cleaning blade 81 has an edge 81*a* that contacts the photoconductor 40.

A description is now given of deformation of the cleaning blade 81.

As described above, the cleaning blade 81 has the edge 81*a* that contacts the photoconductor 40 to scrape the residual toner off the photoconductor 40 while the photoconductor 40 is rotating. A relatively high friction resistance between the photoconductor 40 and the cleaning blade 81 generates relatively large friction therebetween, resulting in failures such as deformation of the cleaning blade 81. For example, the cleaning blade 81 may be curled. Generally, the friction resistance is suppressed by the residual toner between the photoconductor 40 and the cleaning blade 81. However, images formed with a relatively low image area ratio may increase the friction resistance, causing the deformation of the cleaning blade 81.

If images are continuously formed with a relatively low image area ratio partially in a main scanning direction, the friction resistance may increase partially, causing the deformation of the cleaning blade 81. The deformation of the cleaning blade 81 may damage the photoconductor 40, generating defective images. As a result, both the cleaning blade 81 and the photoconductor 40 may require replacement. Similarly, the belt cleaner 17 that includes a cleaning blade to remove residual toner from the intermediate transfer belt 10 may experience the deformation of the cleaning blade and may cause the above-described problems.

In the present embodiment, the image forming apparatus 500 has a tandem-type configuration in which the process units 18K, 18Y, 18M, and 18C are arranged side by side along a direction in which the intermediate transfer belt 10 rotates.

Referring now to FIG. 3, a detailed description is given of a control system of the image forming apparatus 500. In the present embodiment, the controller 510 serves as a cleaning blade failure prediction processor.

FIG. 3 is a block diagram of the controller 510 incorporated in the image forming apparatus 500. The controller 510 is connected to the printer unit 100, the sheet feeder 200, the scanner 300, the document feeder 400, and a control panel 520. The controller 510 is also connected to an external computer 530 such as a personal computer that is connected to the image forming apparatus 500. The controller 510 exerts overall control of the image forming apparatus 500, and includes, e.g., a central processing unit (CPU) 511 serving as a calculator, a random access memory (RAM) 512 serving as a data storage that stores, e.g., calculation data and a control parameter, a read-only memory (ROM) 513 serving as a data storage that stores a control program, and a nonvolatile RAM 514 serving as a data storage. The controller 510 serves as a data acquisition circuit and a cleaning blade failure prediction processor with the CPU 511 executing the control program stored in the ROM 513.

The control panel 520 includes, e.g., a display part and an operation part. The display part is a liquid crystal display or the like that displays, e.g., text information. The operation part receives input data through a ten key or the like and sends the input data to the controller 510. The controller 510 also receives and stores input data from the external computer 530.

Figure 4:
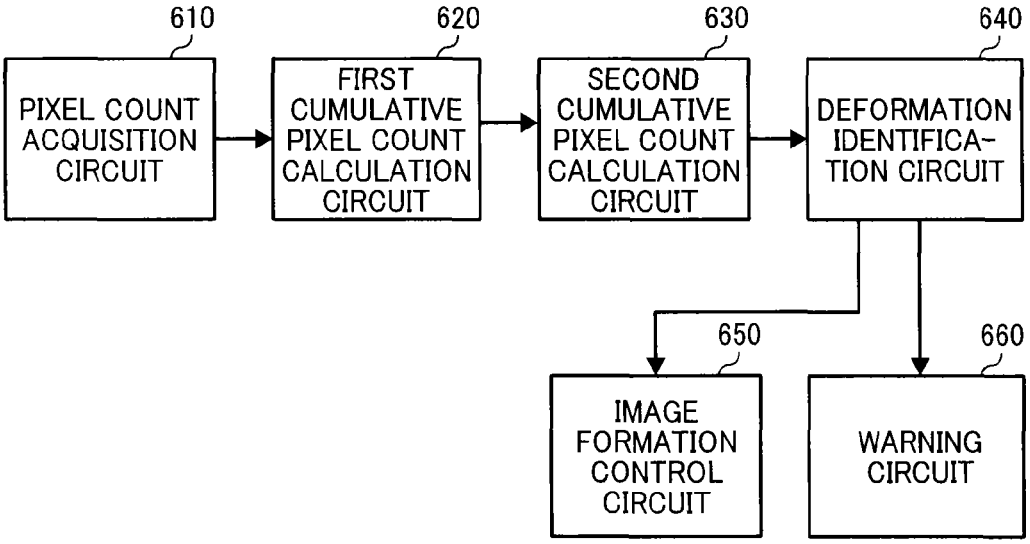
FIG. 4 is a functional block diagram of the controller.

Referring now to FIG. 4, a description is now given of failure prediction performed by the controller 510.

FIG. 4 is a functional block diagram of the controller 510. The controller 510, serving as a cleaning blade failure prediction processor, includes a pixel count acquisition circuit 610, a first cumulative pixel count calculation circuit 620, a second cumulative pixel count calculation circuit 630, a deformation identification circuit 640, an image formation control circuit 650, and a warning circuit 660.

The pixel count acquisition circuit 610 acquires pixel count data of the photoconductor 40 serving as a cleaning target of the cleaning blade 81. Specifically, the photoconductor 40 is divided into a plurality of areas in a main scanning direction of the photoconductor 40, and the pixel count acquisition circuit 610 acquires a pixel count for each of the plurality of areas of the photoconductor 40. The pixel count is extracted from the image data sent from the scanner 300 or the external computer 530. The pixel count thus extracted is accumulated for each of the plurality of areas of the photoconductor 40.

The photoconductor 40 is divided into the plurality of areas by number of pixels. This dividing can be done through the control panel 520. In the present embodiment, the photoconductor 40 is equally divided into sixteen areas in the main scanning direction thereof, and for each of the sixteen areas, the deformation identification circuit 640 determines whether or not the cleaning blade 81 shows signs of failure.

The first cumulative pixel count calculation circuit 620 accumulates the pixel count for each of the plurality of areas of the photoconductor 40 until a component of the image forming apparatus 500 subject to failure prediction is replaced with new one. The second cumulative pixel count calculation circuit 630 divides the cumulative pixel count by a distance traveled to obtain a cumulative pixel count per distance traveled. Alternatively, the second cumulative pixel count calculation circuit 630 may divide a cumulative pixel count per area for a prescribed period of time by a distance traveled for the prescribed period of time to obtain a cumulative pixel count per distance traveled.

The prescribed period of time is determined based on the distance traveled or the number of printed sheets. One way of determining the prescribed period of time is using a lifetime or a fraction of a lifetime of the component of the image forming apparatus 500 subject to diagnosis. For example, a tenth part of the lifetime of the component subject to diagnosis is determined as the prescribed period of time. A failure resulting from the deformation of a cleaning blade (e.g., cleaning blade 81) may be caused by, e.g., continuous image formation with a relatively low image area ratio after image formation with a relatively high image area ratio. The cumulative pixel count for a prescribed period of time contributes to detection of signs of such a failure.

The deformation identification circuit 640 compares the cumulative pixel count per distance traveled obtained by the second cumulative pixel count calculation circuit 630 with a predetermined threshold. If the cumulative pixel count per distance traveled exceeds the threshold, the deformation identification circuit 640 determines that the cleaning blade 81 shows signs of failure.

Figure 5:
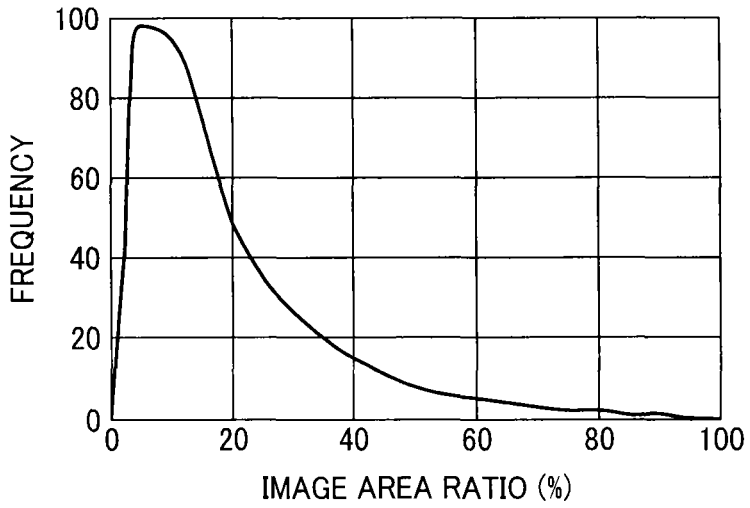
FIG. 5 is a graph illustrating a relationship between image area ratio and frequency.

FIG. 5 is a graph illustrating a relationship between image area ratio and frequency. The vertical axis indicates the frequency while the horizontal axis indicates the image area ratio.

Generally, image formation is performed with an image area ratio of about 5%. Accordingly, if the image area ratio is extremely low, specifically less than 0.1%, the risk of deformation of the cleaning blade 81 may increase. In practice, the image area ratio is rarely set less than 0.1%. However, the image area ratio per area of, e.g., the photoconductor 40 in the main scanning direction thereof may be frequently less than 0.1%. In the image forming apparatus 500, if the image area ratio is less than 0.1%, it is determined that the cleaning blade 81 shows signs of failure. The threshold depends on the machine type and/or the type of the cleaning blade 81.

If the deformation identification circuit 640 identifies an area of the photoconductor 40 in the main scanning direction thereof showing the signs of failure of the cleaning blade 81, the image formation control circuit 650 forms a toner image in the area of the photoconductor 40, thereby decreasing the friction resistance between the cleaning blade 81 and the photoconductor 40. Similarly, if the deformation identification circuit 640 identifies an area of the intermediate transfer belt 10 in a main scanning direction thereof showing the signs of failure of the cleaning blade of the belt cleaner 17, the image formation control circuit 650 forms a toner image in the area of the intermediate transfer belt 10, thereby decreasing the friction resistance between the cleaning blade of the belt cleaner 17 and the intermediate transfer belt 10. The toner image is formed between sheets or after a print job is completed.

Figure 6A:
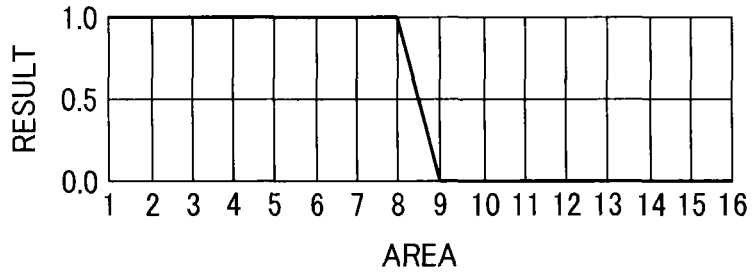
FIG. 6A is a graph showing failure sign identification results per area.
Figure 6B:
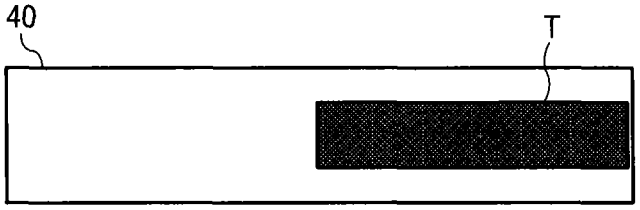
FIG. 6B is a plan view of a toner image formed.

FIG. 6A is a graph showing failure sign identification results per area. FIG. 6B is a plan view of a toner image T formed on the photoconductor 40, in the areas showing the signs of failure of the cleaning blade 81. In FIG. 6A, the vertical axis indicates the failure sign identification results while the horizontal axis indicates the areas. The signs of failure of the cleaning blade 81 are shown in the areas with the identification results of zero. As illustrated in FIG. 6B, the toner image T is formed in the areas showing the signs of failure of the cleaning blade 81 to prevent the deformation of the cleaning blade 81.

If the deformation identification circuit 640 determines that the cleaning blade 81 shows signs of failure, that is, signs of deformation, the warning circuit 660 displays a warning message on the display part of the control panel 520. Alternatively, the warning circuit 660 may transmit a warning about signs of failure to the image forming apparatus 500 via a local area network (LAN) or send an email to, e.g., a maintenance center via a LAN.

Figure 7:
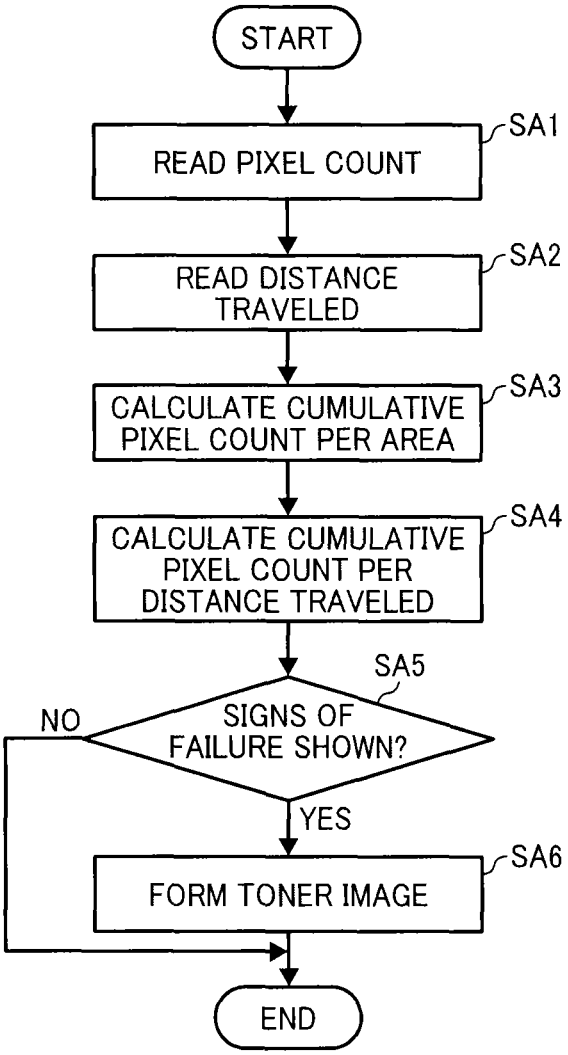
FIG. 7 is a flowchart of a first series of operations of the image forming apparatus.

Referring now to FIG. 7, a detailed description is given of a first series of operations of the image forming apparatus 500.

FIG. 7 is a flowchart of the first series of operations of the image forming apparatus 500. In this example, the image formation control circuit 650 forms a toner image to prevent the deformation of the cleaning blade 81. In step SA1, a pixel count acquired by the pixel count acquisition circuit 610 and stored in the RAM 512 is read. In step SA2, a distance traveled is read. In step SA3, the first cumulative pixel count calculation circuit 620 calculates a cumulative pixel count per area from the pixel count read in SA1. In SA4, the second cumulative pixel count calculation circuit 630 calculates a cumulative pixel count per distance traveled from the distance traveled read in step SA2 and the cumulative pixel count per area calculated in step SA3. In step SA5, the deformation identification circuit 640 compares the cumulative pixel count per distance traveled with a threshold to determine whether or not the cleaning blade 81 shows signs of failure. If the cumulative pixel count per distance traveled is equal to or greater than the threshold and an area showing the signs of failure of the cleaning blade 81 exists (YES in step SA5), the image formation control circuit 650 forms a toner image in the area showing the signs of failure of the cleaning blade 81 in step SA6. On the other hand, if no area shows the signs of failure of the cleaning blade 81 (NO in step SA5), the toner image is not formed, and thus, the first series of operations is completed.

Figure 8:
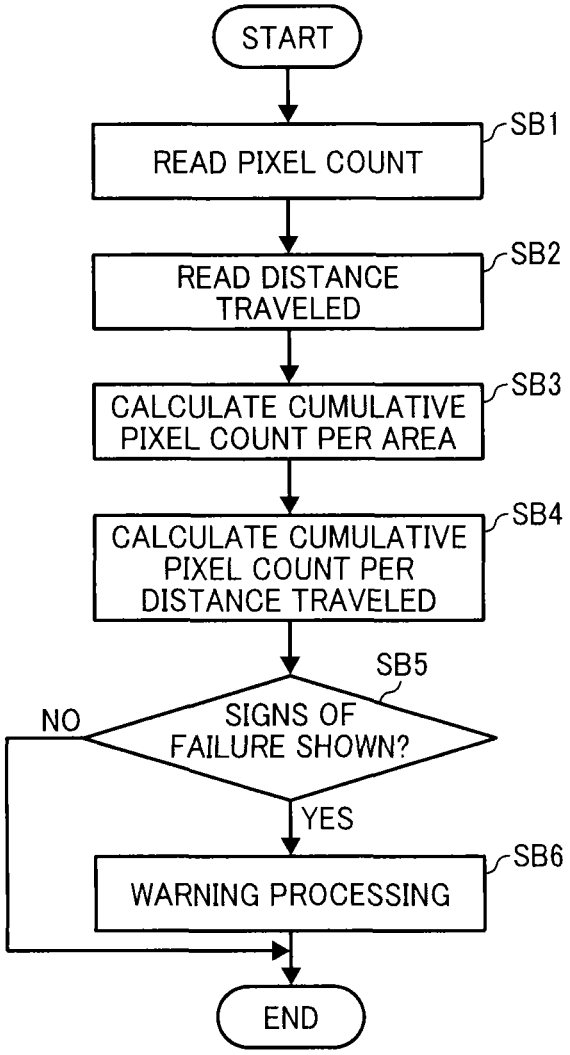
FIG. 8 is a flowchart of a second series of operations of the image forming apparatus.

Referring now to FIG. 8, a detailed description is given of a second series of operations of the image forming apparatus 500.

FIG. 8 is a flowchart of the second series of operations of the image forming apparatus 500. In this example, the warning circuit 660 transmits a warning about deformation of the cleaning blade 81. In this second series of operations, steps SB1 through SB5 are identical to steps SA1 through SA5 of FIG. 7. Thus, for example, in step SB5, the deformation identification circuit 640 compares the cumulative pixel count per distance traveled with a threshold to determine whether or not the cleaning blade 81 shows signs of failure. If the cumulative pixel count per distance traveled is equal to or greater than the threshold and an area showing the signs of failure of the cleaning blade 81 exists (YES in step SB5), the warning circuit 660 executes a warning process in step SB6. For example, the warning circuit 660 displays a warning message on the display part of the control panel 520. Alternatively, the warning circuit 660 may transmit a warning that the cleaning blade 81 shows signs of failure to the image forming apparatus 500 via a LAN, or send an email to a maintenance center via a LAN. On the other hand, if no area shows the signs of failure of the cleaning blade 81 (NO in step SB5), the warning process is not executed, and thus, the second series of operations is completed.

It is to be noted that the image forming apparatus 500 can execute the image formation process with the image formation control circuit 650 while simultaneously executing the warning process with the warning circuit 660. In the above-described embodiment, the cleaning blade 81 that cleans the photoconductor 40 is described as a device subject to prediction of a failure resulting from deformation. Alternatively, the device subject to prediction may be a cleaning blade that cleans another device such as the intermediate transfer belt 10.

Thus, according to the embodiments of the present invention, the deformation of cleaning blades resulting from continuous image formation with a relatively low image area ratio can be predicted for early maintenance, thereby preventing a failure resulting from the deformation of cleaning blades.

The present invention has been described above with reference to specific exemplary embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A cleaning blade failure prediction processor for an image forming apparatus comprising:

a pixel count acquisition circuit to acquire pixel count data of a cleaning target of a cleaning blade, the cleaning target divided into a plurality of areas in a main scanning direction of the cleaning target, the pixel count acquisition circuit acquiring a pixel count for each of the plurality of areas of the cleaning target;

a first cumulative pixel count calculation circuit to calculate a cumulative pixel count for each of the plurality of areas of the cleaning target;

a second cumulative pixel count calculation circuit to calculate a cumulative pixel count per distance traveled of the cleaning target; and a deformation identification circuit to determine whether or not the cleaning blade shows signs of deformation according to the cumulative pixel count per distance traveled.

2. The cleaning blade failure prediction processor according to claim 1, wherein the cleaning target is a photoconductor.

3. The cleaning blade failure prediction processor according to claim 1, wherein the cleaning target is an intermediate transfer body.

4. The cleaning blade failure prediction processor according to claim 1, further comprising an image formation control circuit, wherein the deformation identification circuit determines whether or not the cleaning blade shows signs of failure for each of the plurality of areas of the cleaning target, and wherein, if the deformation identification circuit identifies an area of the plurality of areas of the cleaning target showing the signs of failure of the cleaning blade, the image formation control circuit forms a toner image in the area of the cleaning target.

5. The cleaning blade failure prediction processor according to claim 1, further comprising a warning circuit to transmit a warning if the deformation identification circuit determines that the cleaning blade shows signs of deformation.

6. An image forming apparatus comprising:

the cleaning blade failure prediction processor according to claim 1; and an image formation device that includes the cleaning blade, failure of which is predicted by the cleaning blade failure prediction processor.

7. The cleaning blade failure prediction processor according to claim 1, wherein the second cumulative pixel count calculation circuit is configured to calculate the cumulative pixel count per distance traveled of the cleaning target from the cumulative pixel count calculated by the first cumulative pixel count calculation circuit.

8. The cleaning blade failure prediction processor according to claim 7, wherein the second cumulative pixel count calculation circuit is configured to calculate the cumulative pixel count per distance traveled of the cleaning target by dividing the cumulative pixel count by a distance traveled by the cleaning target.

9. The cleaning blade failure prediction processor according to claim 7, wherein the second cumulative pixel count calculation circuit is configured to calculate the cumulative pixel count per distance traveled of the cleaning target by dividing the cumulative pixel count for a prescribed period of time by a distance traveled by the cleaning target during the prescribed period of time.

10. A cleaning blade failure prediction processor for an image forming apparatus comprising:

circuitry configured to acquire pixel count data of a cleaning target of a cleaning blade, the cleaning target divided into a plurality of areas in a main scanning direction of the cleaning target, the circuitry acquiring a pixel count for each of the plurality of areas of the cleaning target;

calculate, from the acquired pixel count data, a cumulative pixel count per distance traveled of the cleaning target; and determine whether or not the cleaning blade shows signs of deformation according to the cumulative pixel count per distance traveled.

* * * * *